US010436027B2

(12) United States Patent
Kampfer et al.

(10) Patent No.: US 10,436,027 B2
(45) Date of Patent: Oct. 8, 2019

(54) METHOD OF GEOMETRIC EVALUATION OF HYDRAULIC FRACTURES

(71) Applicant: STATOIL GULF SERVICES LLC, Houston, TX (US)

(72) Inventors: Günther Kampfer, Houston, TX (US); Matthew A. Dawson, Houston, TX (US)

(73) Assignee: STATOIL GULF SERVICES LLC, Houston, TX (US)

( * ) Notice: Subject to any disclaimer, the term of this patent is extended or adjusted under 35 U.S.C. 154(b) by 0 days.

(21) Appl. No.: 15/975,596

(22) Filed: May 9, 2018

(65) Prior Publication Data

US 2018/0258762 A1 Sep. 13, 2018

Related U.S. Application Data

(63) Continuation of application No. 14/788,056, filed on Jun. 30, 2015, now Pat. No. 9,988,900.

(51) Int. Cl.

| | |
|---|---|
| ***G01V 1/40*** | (2006.01) |
| ***E21B 49/00*** | (2006.01) |
| ***E21B 43/26*** | (2006.01) |

(52) U.S. Cl.

CPC ..... *E21B 49/008* (2013.01); *E21B 43/26* (2013.01)

(58) Field of Classification Search

CPC ..... E21B 49/008; E21B 43/26
USPC ..... 702/6
See application file for complete search history.

(56) References Cited

U.S. PATENT DOCUMENTS

| | | | |
|---|---|---|---|
| 6,268,911 | B1 | 7/2001 | Tubel et al. |
| 6,281,489 | B1 | 8/2001 | Tubel et al. |
| 6,302,204 | B1 | 10/2001 | Reimers et al. |
| 6,531,694 | B2 | 3/2003 | Tubel et al. |
| 6,588,266 | B2 | 7/2003 | Tubel et al. |
| 6,787,758 | B2 | 9/2004 | Tubel et al. |
| 6,828,547 | B2 | 12/2004 | Tubel et al. |

(Continued)

FOREIGN PATENT DOCUMENTS

| | | |
|---|---|---|
| WO | WO 2013/008195 A2 | 1/2013 |
| WO | WO 2014/058745 A2 | 4/2014 |
| WO | WO 2014/121270 A2 | 8/2014 |

OTHER PUBLICATIONS

Escobar et al., "Rate-Transient Analysis for Hydraulically Fractured Vertical Oil and Gas Wells," ARPN Journal of Engineering and Applied Science, vol. 9, No. 5, May 2014, pp. 739-749.

(Continued)

*Primary Examiner* — Caleb E Henry
(74) *Attorney, Agent, or Firm* — Birch, Stewart, Kolasch & Birch, LLP

(57) ABSTRACT

A method of evaluating a geometric parameter of a first fracture emanating from a first wellbore penetrating a subterranean formation is provided. The method includes the steps of forming the first fracture in fluid communication with the first wellbore; forming a second fracture in fluid communication with a second wellbore; measuring a first pressure change in the second wellbore in proximity to the first wellbore; and determining the geometric parameter of the first fracture using at least the measured first pressure change in an analysis which couples a solid mechanics equation and a pressure diffusion equation.

17 Claims, 4 Drawing Sheets

(56) References Cited

U.S. PATENT DOCUMENTS

| | | | | |
|---|---|---|---|---|
| 7,028,772 | B2 | 4/2006 | Wright et al. | |
| 7,040,390 | B2 | 5/2006 | Tubel et al. | |
| 7,201,221 | B2 | 4/2007 | Tubel et al. | |
| 7,397,388 | B2 | 7/2008 | Huang et al. | |
| 7,819,181 | B2 | 10/2010 | Entov et al. | |
| 8,061,427 | B2 | 11/2011 | Jackson et al. | |
| 8,204,727 | B2 | 6/2012 | Dean et al. | |
| 8,511,384 | B2 | 8/2013 | Valdez | |
| 8,789,587 | B2 | 7/2014 | Tubel et al. | |
| 8,807,222 | B2 | 8/2014 | Jeronimo | |
| 9,164,192 | B2 | 10/2015 | Maerten et al. | |
| 2002/0066309 | A1 | 6/2002 | Tubel et al. | |
| 2003/0205083 | A1 | 11/2003 | Tubel et al. | |
| 2004/0043501 | A1 | 3/2004 | Means et al. | |
| 2006/0102342 | A1 | 5/2006 | East et al. | |
| 2011/0067857 | A1 | 3/2011 | Underhill et al. | |
| 2011/0120718 | A1* | 5/2011 | Craig | E21B 43/16 166/308.1 |
| 2011/0264373 | A1 | 10/2011 | Hehmeyer et al. | |
| 2013/0191044 | A1 | 7/2013 | Maerten et al. | |
| 2013/0298665 | A1 | 11/2013 | Minchau | |
| 2014/0048270 | A1* | 2/2014 | Soliman | E21B 43/26 166/308.1 |
| 2014/0166280 | A1 | 6/2014 | Stone et al. | |
| 2014/0262239 | A1* | 9/2014 | Keller | E21B 33/1208 166/250.01 |
| 2014/0262240 | A1* | 9/2014 | Boone | E21B 47/00 166/250.01 |
| 2014/0288840 | A1 | 9/2014 | Vermilye et al. | |
| 2015/0075775 | A1 | 3/2015 | Davidson et al. | |
| 2015/0075777 | A1 | 3/2015 | Walters et al. | |
| 2015/0075778 | A1 | 3/2015 | Walters et al. | |
| 2015/0075779 | A1 | 3/2015 | Walters et al. | |
| 2015/0083398 | A1* | 3/2015 | Dawson | E21B 43/16 166/245 |
| 2015/0083405 | A1 | 3/2015 | Dobroskok et al. | |
| 2015/0176394 | A1 | 6/2015 | Roussel et al. | |
| 2015/0211347 | A1 | 7/2015 | Snider et al. | |
| 2016/0003017 | A1* | 1/2016 | Keller | E21B 43/162 166/250.1 |
| 2016/0047215 | A1* | 2/2016 | Soliman | E21B 43/26 166/250.1 |
| 2017/0145793 | A1* | 5/2017 | Ouenes | E21B 41/0092 |

OTHER PUBLICATIONS

Nolte, "Determination of Fracture Parameters from Fracturing Pressure Decline," Society of Petroleum Engineers of AIME, SPE 8341, 1979, pp. 1-11 (16 pages total).

* cited by examiner

METHOD OF GEOMETRIC EVALUATION OF HYDRAULIC FRACTURES

CROSS-REFERENCE TO RELATED APPLICATIONS

This application is a Continuation of U.S. patent application Ser. No. 14/788,056 filed on Jun. 30, 2015, the entire contents of which is hereby expressly incorporated by reference into the present application.

BACKGROUND OF THE INVENTION

1. Field of the Invention

The present invention relates to completion/reservoir technology, and more particularly to a method of geometric evaluation of hydraulic fractures for a multi-well pad.

2. Description of Background Art

Over the years, the research on reservoir technology focuses on maximizing the value of ultra-tight resources, sometimes referred to as shales or unconventional resources. Ultra-tight resources, such as the Bakken, have very low permeability compared to conventional resources. They are often stimulated using hydraulic fracturing techniques to enhance production and often employ ultra-long horizontal wells to commercialize the resource. However, even with these technological enhancements, these resources can be economically marginal and often only recover 5-15% of the original oil in place under primary depletion. Therefore, optimizing the development of these ultra-tight resources by evaluating geometry of hydraulic fracture so as to optimize the well spacing and completions is critical. In addition to improving economics with optimized well spacing and completions, increasing certainty around hydraulic fracture geometry will also enable increased certainty around matrix permeability since these two parameters are often integrally linked in production analysis. Improved understanding of matrix permeability will lead to a better predict of decline curves, and thus, ultimate recovery estimates and reserves estimates. Moreover, with the increase in demand of maximizing the value from the unconventional reservoirs, enhanced oil recovery (EOR) technologies are becoming increasingly important. One of the key aspects of nearly all EOR technologies is well to well communication. An improved understanding of hydraulic fracture geometry will also enable better evaluation of the EOR potential in unconventional reservoirs.

Although the importance of understanding hydraulic fracture geometry has been recognized in industry for well over a decade, a low-cost, technically robust technology, which can map hydraulic fractures has yet to be commercialized. Hydraulic fracturing has been used for decades to enhance the producibility of tight-gas reservoirs. The fundamentals of fluid transport in fractures, matrix leakoff, and fracture mechanics during fracture propagation have been well-studied, leading to the development of pseudo-3D and planar 3D fracture propagation simulation models, as well as bottomhole treatment pressure analysis tools. These tools have been widely used for estimating fracture lengths and drainage boundaries in hydraulically fractured tight-gas reservoirs. However, despite the wealth of knowledge in tight-gas reservoirs and studies on hydraulic fracture propagation dating back to when Sneddon (1946) developed one of the first fracture propagation models, understanding the fracturing process in unconventional reservoirs is still in its infancy. Shale reservoirs are complex and heterogeneous. Moreover, they often contain natural fractures, faults, and other planes of weakness, which can complicate fracture propagation. The interaction between hydraulic and natural fractures can lead to reactivation of natural fractures and complex fracture growth. Although there have been recent attempts to model complex fracture propagation, the mechanics of network growth is not fully understood, and reservoir characterization and simulation in three dimensions remains challenging. This has limited the applicability of fracture models in ultra-tight, complex plays.

In conventional oil fields, there are many methods used for attempting to evaluate hydraulic fracture geometry and optimize well spacing. One of the most common methods which has been widely adopted is to use subsurface or surface micro-seismic arrays to monitor seismic events during the hydraulic fracturing process. Ideally, this would provide insight into the dimensions of hydraulic fractures, helping to determine the optimal well-to-well spacing. However, this technology is costly and is often questionable for a number of reasons. First, and foremost, it is often accepted that microseismic predominantly identifies shear events, which may or may not be associated with the growth of hydraulic fractures. Microseismic events are linked with the creation and dilation of hydraulic fractures but do not necessarily only occur where the fracture fluid or even proppants are placed. The stress state in the rocks adjacent to the hydraulic fracture is altered from its initial state and hence there are plenty of possible explanations for microseismic events, for example by reactivating pre-existing planes of weakness or micro fractures within the surrounding rock which are not at all hydraulically connected to the well. Therefore there is a huge uncertainty on the hydraulic fracture geometry. A second challenge with microseismic is that it requires knowledge of the subsurface, particularly wave velocities in the media, which are often unknown and have high uncertainty. Finally, the processing methods themselves are often brought into question, as many service companies who provide this technique use veiled algorithms and openly admit the uncertainty in these processing methods.

Another technology which has been used to evaluate hydraulic fracture geometry is downspacing tests, where varying well-to-well spacings are chosen for different pads and production is compared at different spacings to assess which spacing is optimal. This technique is expensive and time consuming and often gives a highly uncertain answer, requiring this procedure to be repeated many times, in a cost inefficient manner, to increase accuracy in the result. This procedure, which often ends up with under drilling and over drilling numerous pads, can significantly reduce the value of the resource due to inefficient development.

There are other alternative technologies for mapping hydraulic fractures currently being explored, but many of these technologies provide only qualitative information or require expensive data acquisition tools.

To date, no methods for evaluating hydraulic fracture geometry and optimizing the well spacing with less cost, more accurate results, and much fewer wells and inefficiently developed pads compared with the above mentioned conventional methods, have been successfully deployed in ultra-tight oil resources. Therefore, there is an industry-wide need for a method for evaluating hydraulic fracture geometry and optimizing well spacing for a multi-well pad in order to better understand optimal well-to-well spacing, so as to maximize the value of ultra-tight resources with less cost and higher certainty.

SUMMARY OF THE INVENTION

Accordingly, it is an object of the present invention to provide a method of evaluating hydraulic fracture geometry for optimizing well spacing for a multi-well pad, which can avoid under drilling or over drilling numerous pads, reduce cost, and increase the certainty of results.

To achieve the above-mentioned object, according to a first aspect of the present invention, a method of evaluating a geometric parameter of a fracture emanating from a wellbore penetrating a subterranean formation is provided. The method includes the steps of forming the first fracture in fluid communication with the first wellbore; forming a second fracture in fluid communication with a second wellbore; measuring a first pressure change in the second wellbore in proximity to the first wellbore; and determining the geometric parameter of the first fracture using at least the measured first pressure change in an analysis which couples a solid mechanics equation and a pressure diffusion equation.

The present invention provides an improved approach for mapping hydraulic fractures by using measured pressures during the hydraulic fracturing process, which have their origin in a poroelastic response due to the propagation and dilation of a hydraulic fracture. The proposed approach uses low cost surface gauges to minimize capital expenditure, but it can also be used with downhole pressure gauges. The proposed approach also overcomes the challenge of locating the origin of the pressure signals in the monitor well by isolating a single stage along the lateral from prior stages. For instance, isolating a single stage in the monitor well can be achieved by isolating the annulus with a packer and isolating the interior of the well with a bridge plug. After isolation, the stage in the monitor well can be completed and surface pressure measurements are recorded, measuring the response in a single stage in the monitor well. Thus, the spatial location can be known for both the isolated stage in the monitor well as well as any stages undergoing completions in adjacent wells. The pressure data can then be used to more precisely evaluate direct fluid communication between stages as well as hydraulic fracture overlap, height, and proximity.

The present invention offers significant advantages in the field of reservoir technology for evaluating hydraulic fracture geometry and optimizing well spacing for a multi-well pad, such as costing a mere fraction of alternative approaches, requiring much fewer wells and much fewer inefficiently developed pads than the conventional approach of well spacing testing with variable spacings on a pad, and also requiring far less money and giving a more certain result than existing technologies such as microseismic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to one of ordinary skill in the art from this detailed description.

BRIEF DESCRIPTION OF THE DRAWINGS

The present invention will become more fully understood from the detailed description given below and the accompanying drawings that are given by way of illustration only and are thus not limitative of the present invention.

DETAILED DESCRIPTION OF THE INVENTION

Figure 1:
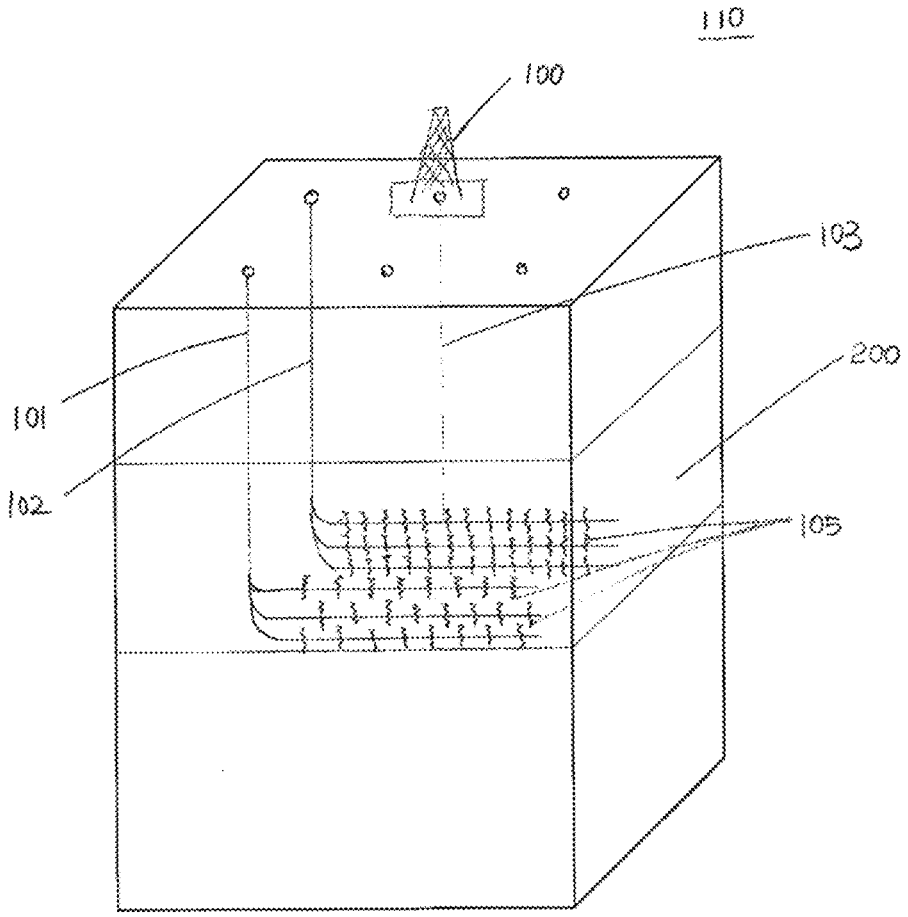
FIG. 1 is an exemplary diagram of a drilling operation on a multi-well pad.

The present invention will now be described in detail with reference to the accompanying drawings, wherein the same reference numerals will be used to identify the same or similar elements throughout the several views. It should be noted that the drawings should be viewed in the direction of orientation of the reference numerals.

The present invention is directed to evaluate hydraulic fracture geometry by measuring pressure changes in an observation well stage while hydraulic fractures are created in adjacent well(s) for a multi-well pad, and performing an analysis which couples a solid mechanics equation and a pressure diffusion equation.

FIG. 1 shows an exemplary diagram of a drilling operation on a multi-well pad. One of ordinary skill in the art will appreciate that the drilling operation shown in FIG. 1 is provided for exemplary purposes only, and accordingly should not be construed as limiting the scope of the present invention. For example, the number of groups of wells and the number of wells in each group are not limited to those shown in FIG. 1. It is also noted that the wells may be conventional vertical wells without horizontal sections.

As depicted in FIG. 1, the operation environment may suitably comprise several groups of wells 101, 102, 103 drilled by a drilling rig 100 from a single pad 110. The wells have vertical sections extending to penetrate the earth until reaching an oil bearing subterranean formation 200, and horizontal sections extending horizontally in the oil bearing subterranean formation 200 in order to maximize the efficiency of oil recovery. The formation can be hydraulically stimulated using conventional hydraulic fracturing methods, thereby creating fractures 105 in the formation. It is noted that while FIG. 1 illustrates that the several groups of wells 101, 102, 103 reach the same oil bearing subterranean formation 200, this is provided for exemplary purposes only, and in one or more embodiments of the present invention, the groups and the wells in different groups can be in different formations, for example, two different formations, Three Forks formation and Middle Bakken formation. According to an embodiment of the present invention, a method has been developed for evaluating hydraulic fracture geometry and optimizing well spacing for a multi-well pad by sequencing hydraulic fracturing jobs for the multi-well pad and monitoring the pressure in said monitor well while hydraulic fractures are created in adjacent well(s), so that highly valuable data can be acquired for analyzing to evaluate hydraulic fracture geometry, proximity, and connectivity.

Figure 2:
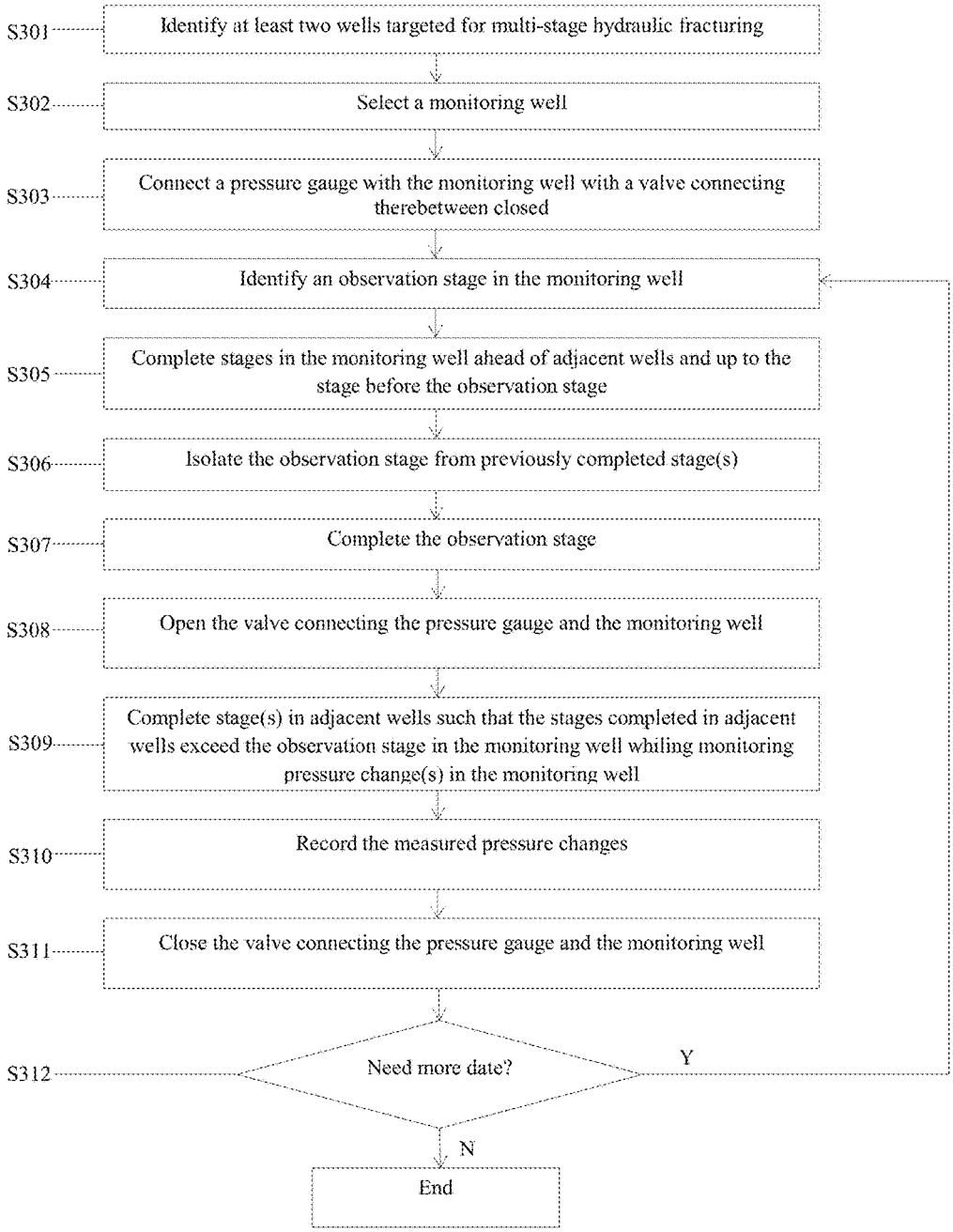
FIG. 2 is a flowchart in accordance with one embodiment of the present invention.

FIG. 2 is a flowchart in accordance with one embodiment of the present invention. Specifically, FIG. 2 is a flowchart of a method of acquiring data for evaluating hydraulic fracture geometry for a multi-well pad, which includes at least two wells in accordance with one embodiment of the present invention. In this embodiment, the group includes two wells. However, in one or more embodiments of the present invention, there may be more than one group of wells, and each of the groups may include three or more wells, and some wells in one group may be common with the other group.

In one embodiment of the present invention, a single multi-well pad includes at least two wells targeted for multi-stage hydraulic fracturing identified in S301.

In S302, one of the at least two wells is selected to be the monitoring well to be connected with a pressure gauge for monitoring the pressure changes. After the monitoring well is selected, in S303, a pressure gauge is connected in direct fluid communication with the monitoring well in order to monitor the pressure changes in the step(s). The pressure gauge may be, but is not limited to, a surface pressure gauge or a subsurface pressure gauge. Among suitable pressure measurement techniques, the surface gauge approach is far simpler and far less costly, reducing the risk of implementation and cost by orders of magnitude. Traditionally, the surface gauges have only been used for evaluating direct communication between wells. They have not been used for determining hydraulic fracture properties such as proximity, geometry, overlap, etc. They also do not allow for a waiting period between the time the last stage was fractured in the monitor well and the time at which point pressure is read in that well for adjacent wells of interest. The method according to the present invention here is using the surface gauge to acquire pressure information associated with an isolated observation stage in the monitoring well, and allowing for a resting period so that the location of the isolated observation stage can be better understood by detecting and interpreting smaller signals, which in turn enables calculation of the proximity and overlap of new fractures growing near the observation fractures. In one or more embodiments of the present invention, SPIDR gauges or similar high-quality gauges with resolution below 1 psi and preferably 0.1 psi and a range of up to 10,000 psi are recommended.

It is noted that the surface pressure gauge should be isolated, i.e., the valve connecting the pressure gauge and the monitoring well maintaining closed, from the well during stimulation of the monitoring well.

In S304, a stage targeted for hydraulic fracturing of the monitoring well is selected to be the observation stage. It is noted that any well can be set as the monitor well, and any stage from the first stage and up can be set as the observation stage.

In S305, fractures are created in the monitoring well up to the stage immediately before the observation stage. The fracturing operation can be carried out using any suitable conventional hydraulic fracturing methods. The fractures emanating from the monitoring well are in contact with an oil-bearing subterranean formation, which can be the same as the oil-bearing subterranean formation being contacted with the fractures created in adjacent well(s), or may be a different formation. The fracturing operation may include sub-steps of drilling a well hole vertically or horizontally; inserting production casing into the borehole and then surrounding with cement; charging inside a perforating gun to blast small holes into the formation; and pumping a pressurized mixture of water, sand and chemicals into the well, such that the fluid generates numerous fractures in the formation that will free trapped oil to flow to the surface. It is noted that the fracturing operation can be carried out using any suitable conventional hydraulic fracturing method, and is not limited to the above mentioned sub-steps. While creating fracturing in the monitoring well, fractures may also be creating in the adjacent well(s).

After the fractures are created in the monitoring well up to immediately before the observation stage, in S306, the observation stage is isolated from the previously completed stages by an isolating device. The isolating device may be, but is not limited to, installing a bridge plug internally in the monitoring well while swell-packers exist externally around the well before the observation stage. For example, if the observation stage is set to be the stage 11 of the monitoring well, the bridge plug should be instilled after the stage 10. The bridge plug may be retrievable and set in compression and/or tension and installed in the monitoring well before the observation stage. In one or more embodiments of the present invention, the bridge plug may also be non-retrievable and drilled out after the completions are finished. It is noted that other suitable isolation devices can also be used.

After the observation stage in the monitoring well is isolated from the previously completed stages, in S307, a fracture is created in the observation stage. It should be noted that during S307, the valve connecting the pressure gauge and the monitoring well should still remain closed. The fracturing operation can be carried out using any suitable conventional hydraulic fracturing method. The fracture emanating from this stage is in contact with an oil-bearing subterranean formation. It is noted that S307 is a critical step, such that there is sufficient mobile fluid to accommodate the compressibility in the monitoring well and deliver the actual subsurface pressure signal.

After the observation stage is completed, in S308, the valve for the pressure gauge connecting with the monitoring well is opened such that the pressure gauge is in direct fluid communication with the observation stage in the monitoring well. It is noted that the next stage in the monitoring well should not be perforated until the pressure monitoring is completed. For example, if the stage 11 of the monitoring well is set to be the observation stage, the stage 12 should not be perforated until the pressure monitoring for the observation stage 11 is completed.

After the valve for the pressure gauge is opened, in S309, fracturing operations are performed to adjacent well(s) that are in contact with an oil-bearing subterranean formation. The adjacent well(s) is adjacent to the monitor well so that the fractures in the adjacent well(s) induce the pressure being measured in the monitoring well to change. It is noted that an adjacent well is not limited to an immediately adjacent well or even a well in the same formation or stratigraphic layer, as long as the fractures in said well can induce the pressure being measured in the monitoring well to change. It is preferable that the number of stages completed in each of the adjacent well(s) exceeds the number of stages completed in the monitoring well. More preferably, at least two stages before the observation stage and at least two stages after the observation stage in the adjacent well(s) should be completed in S309, while the pressure in the monitoring well is monitored by the pressure gauge. For example, if the stage 11 of the monitoring well is set to be the observation stage, it is preferable to ensure that at least stages 9-13 in the adjacent well(s) should be completed in S309 while the pressure in the monitoring well is monitored by the pressure gauge. It should also be noted that the stage numbers in the monitoring well and the adjacent well(s) may or may not correspond to each other depending on the well length and stage placement. When the stage numbers in the monitoring well and the adjacent well(s) do not correspond to each other, it is preferable to ensure that the stages being completed in the adjacent well(s), while the pressure in the monitoring well is monitored by the pressure gauge, should include stages both before and after the observation stage.

Determining the monitoring stage numbers and identifying the adjacent wells stages influencing the pressure in the monitoring stage may not be straight forward, in case the wells are not drilled aligned with the minimum horizontal compressive stress direction, since in such a case the induced fractures may be oblique to the well axis. However, this is a preferred data collection scenario, since in such a case the dataset is very rich, covering a large space on the pore pressure map. During S309, no molecule contained in the fracture created in the monitoring well physically interacts with a molecule contained in the fracture created in the adjacent well(s), and no molecule existing in the fracture created in the monitoring well exists in the fracture created in the adjacent well(s) simultaneously.

The measured pressures are recorded in S310. After the monitoring is completed, in S311, the valve connecting the pressure gauge and the monitoring well is closed. Further fracturing operations may then be performed in the next stage in the monitoring well. In S312, a determination is made to decide whether more data is needed, and if yes, S304-S312 may be repeated as many times as desired. The repeating operation may start with selecting a new observation stage. It is preferable to have two or three observation stages in one monitoring well. However, in one or more embodiments, there may be more than one monitoring well, and in that case, one observation stage per monitoring well may be sufficient.

By designing the sequence of stage timings as outlined above, surface pressure responses of individual fracturing stages in adjacent wells can be recorded in the isolated observation stage of the monitoring well, for using to more precisely evaluate direct fluid communication between stages as well as hydraulic fracture overlap, height, and proximity.

Figure 3A:
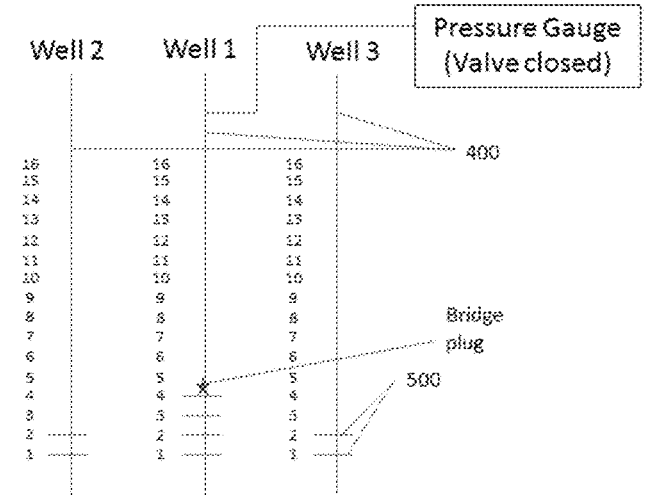
FIGS. 3*a*-3*c* are exemplary diagrams of the stage sequencing of a hydraulic fracturing operation for a multi-well pad according to one embodiment of the present invention.
Figure 3B:
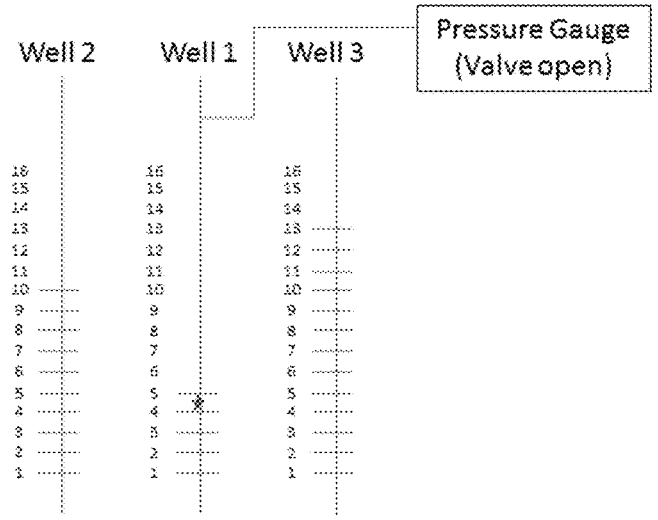
Figure 3C:
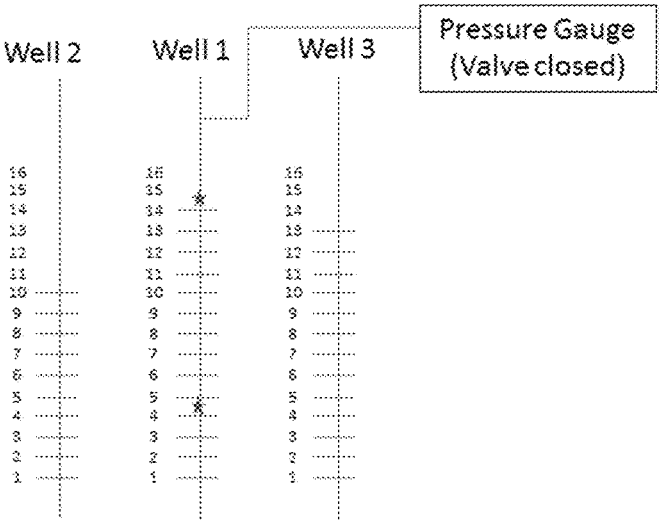

FIGS. 3*a*-3*c* are exemplary diagrams of the stage sequencing of a hydraulic fracturing operation for a multi-well pad according to one embodiment of the present invention.

FIG. 3*a* shows a group of wells represented by the vertical lines 400 including three wells, Well 1, Well 2, and Well 3. It is noted that the numbers of groups of wells and the types of wells in terms of the formation are not limited to those shown in FIGS. 3*a*-3*c*. It is also noted that the Well 1, Well 2, and Well 3 are not limited to be in the same formation and they may be in different formations, respectively, such as a Three Forks formation and a Middle Bakken formation, for instance. One of ordinary skill in the art will appreciate that the exemplary diagrams of the stage sequencing shown in FIGS. 3*a*-3*c* are provided for exemplary purposes only. The horizontal lines 500 intersecting the vertical lines 400 illustrate fractures created in each well, and the numbers beside the horizontal lines 500 illustrate the sequencing of the stages in each well. As shown in FIG. 3*a*, Well 1 is selected to be the monitor well, and the stage 5 of the Well 1 is set to be the observation stage. A pressure gauge is connected to the monitoring well, and the valve connecting the pressure gauge and the monitoring well remains closed until the observation stage is completed. Two stages have been completed in each of Well 2 and Well 3. For the monitoring well, Well 1, since the stage 5 has been set to be the observation stage, the fracturing operations are performed up to the stage 4. The number of stages completed in each well is not limited to the illustration in FIG. 3*a*. However, in the presented sketches the stress orientations are chosen such that it is preferable that the number of stages completed in Well 1 at this time exceed the number of stages completed in each of Well 2 and Well 3. After the stage 4 of Well 1 is completed, a bridge plug, represented by a star, is installed between the stage 4 and stage 5 in Well 1, so that stage 5, the observation stage, is isolated from the previously completed stages in Well 1.

Turning to FIG. 3*b*, after the stage 5 of Well 1 is isolated, a fracture is created in the stage 5. After the fracturing of the stage 5 in Well 1 is completed, the valve connecting the pressure gauge to Well 1 is opened such that the pressure gauge is in direct fluid communication with the isolated stage 5 in Well 1. At this time, the stage 6 in Well 1 has not yet been prepared by plugging and perforating. It is noted that the plugging and perforating operation mentioned here may adopt any suitable conventional systems, such as the open-hole (OH) graduated ball-drop fracturing isolation system where the ball isolates the next stage from the previous stage. It is further noted that being in direct fluid communication mentioned above is defined as no impermeable barrier to liquid molecules existing between the fluid in contact with the pressure gauge and the fluid residing in the isolated stage 5 in Well 1. After the valve for connecting the pressure gauge to Well 1 is opened and the pressure gauge is in direct fluid communication with the isolated stage 5 in Well 1, another eight stages of fracturing operations have been performed to Well 2 and another twelve stages of fracturing operations have been performed to Well 3, while the pressure gauge is monitoring the pressure changes in Well 1. Since Well 2 and Well 3 are adjacent wells of the monitor well, Well 1, the fracturing operations performed in Well 2 and Well 3 induce the pressure being measured by the pressure gauge in the monitoring well to change. The pressure change is then recorded for further processing in order to evaluate hydraulic fracture geometry and thereby determine optimal well spacing for further drilling operations. It is noted that the numbers of stages undergoing fracturing operations in Well 2 and Well 3 are not limited to that shown in FIG. 3*b*.

Turning to FIG. 3*c*, after the monitoring is completed, the valve for connecting the pressure gauge to Well 1 is closed. Stage 6 in Well 1 is then plugged and perforated for preparation of performing a fracturing operation. In this embodiment illustrated in FIG. 3*c*, a determination for obtaining more monitoring data is made, and a repeating operation, as in S304-S312 mentioned above, is performed. As shown in FIG. 3*c*, the stage 15 in Well 1 is set to be the new observation stage, and then fracturing operations are performed to the stage 6 to the stage 14 in Well 1. After that, the new observation stage 15 is isolated, by installing a bridge plug between the stage 14 and the stage 15 in Well 1, from the previously completed stages in Well 1. After that, the procedure as mentioned above in S307-S312 is performed and is not further illustrated. It is noted that the repeating operation can be performed as many times as desired, until sufficient monitoring pressure data is obtained.

After sufficient monitoring pressure data is obtained, the recorded pressure changes in the monitor well are analyzed and processed to obtain information related to the geometry of the fracture. The analyzing and processing of the recorded pressure changes may be realized by digital electronic circuitry or hardware, including a programmable processor, a computer, a server, or multiple processors, computers or servers and their structural equivalents, or in combinations of one or more of them.

In one or more embodiments of the present application, a computer algorithm which accounts for poromechanics may be used. The method of analyzing the data may include a number of methods involving computer simulations. In one or more embodiments of the present invention, typical commercial reservoir simulators can be used to evaluate the maximum fluid connectivity that could exist between wells and still not exceed the pressure signals observed. This can help one identify if there are pervasive connected natural fracture networks or to what extent the overall system allows for flow between an induced fracture in an adjacent well and the monitor well. In some other embodiments, hydraulic fracturing commercial simulators can be used in conjunction with the pressure data and inputs such as rate, pressure, injection duration and volume into the adjacent well to simulate hydraulic fracture growth and estimate the fracture geometry. In a preferred embodiment of the present invention, an advanced simulation tool, which coupled poromechanics with transport to capture the total induced pressure signal that could be seen in the observation fracture from the monitor well from a newly induced fracture in the adjacent well, is used. The above mentioned simulators for instance could use a coupled finite element-finite volume (FE-FV) scheme for more accurate analysis, and a parametric study could be undertaken to develop a contour plot to evaluate the geometry of hydraulic fractures more precisely by simply using the observed pressure response. With this type of method, both the overlap and the distance between fractures (spacing of fractures) can be determined with information obtained from the measured pressure changes in the monitor well. This also allows for less complex analytical analyses of the pressure data, which can shed light on whether communication responses were induced via poroelastic effects or whether they are caused from direct fluid communication.

In one or more embodiments of the present application, an instantaneous shut-in pressure (ISIP) is measured for the stage fractured and is then used in conjunction with the measured pressure change to evaluate the communication between the monitor well and the adjacent wells. More specifically, in one or more embodiments of the present invention, input parameters into the above mentioned analyses include the measured pressure changes in the monitor well, and the ISIP of the next stage in the monitoring well. The rate of change in the pressure response and the magnitude are clear indicators of either direct fluid communication or poroelastic influence. An example of direct fluid communication would be a dramatic rise in pressure (100's of psi)—often closely approaching the ISIP (typically within 10% of the ISIP would be a characteristic indicator) in a matter of minutes (less than 15 min) under standard hydraulic fracturing injection rates in excess of 30 barrels per minute into the adjacent well. But if the injection rate into the adjacent well is less than the above mentioned, direct fluid communication may still be observed with significant pressure increase but over longer periods of time. Basically, the duration of time of the pressure rise from trough to peak can be estimated based on the injection rate into the adjacent well. Poromechanics signals on the other hand are typically less than a couple hundred psi and typically less than 10's of psi. They have a more gradual rate of change as the fractures grow and overlap each other more and more inducing larger poromechanics responses, and they can yield continued pressure increases even after injection has stopped in the adjacent well as the fractures continue to propagate and as the pressure in the fractures equilibrates with time.

In one or more embodiments of the present application, the analysis of the recorded pressure data applies coupled solid mechanics and pressure diffusion equations to obtain pressure maps. A solid mechanics equation is an equation that accounts for equilibrium and satisfies a constitutive relation between stress and strain. Solid mechanics equations can be used to describe the deformation of a body under varying boundary conditions. A pressure diffusion equation is an equation that accounts for mass conservation and describes the motion of a fluid. Pressure diffusion equations can be used to describe how a fluid will react to a change in a boundary condition, for example a change in fluid pore pressure. In one or more embodiments of the present invention, the coupling between the solid mechanics equation and the pressure diffusion equation is one-way. In one or more embodiments of the present invention, the coupling between the solid mechanics equation and the pressure diffusion equation is two-way. Coupling as defined herein is the act of passing information. Therefore, in the case of one-way coupling, information from one equation is used in the other equation. For instance in a first embodiment, at a given location pressure may be solved for in the pressure diffusion equation That pressure may then be used in the solid mechanics equation. In a second embodiment one may use a mechanics equation only to solve for volumentric strain and then use strain in combination with a correlation to get a pore pressure increase in the pressure diffusion equation. In the case of two-way coupling, the same information is used in both equations. For instance, the pressure term may be used in both the solid mechanics equation and the pressure diffusion equation. Likewise, the porosity may be used in both equations. The equations can be solved simultaneously in what is termed a fully-coupled solution or solved iteratively in a sequential solution or solved using an alternative scheme.

The simulation re-produces the poroelastic pressure increase one would expect in an observation fracture, at a certain distance to a second fracture, which is pressurized/dilated/propagating. A series of such simulations for various distances between the two fractures are conducted and the resulting normalized pressure increase is then displayed on a surface plot spanned in a normalized space of fracture overlap and fracture offset. These maps are very sensitive to the fracture geometry, i.e. the fracture height. The combination of the measured pressure signals and the surface plots for different fracture height to length ratios provide the final geometry of the hydraulic fracture in the subsurface.

Another embodiment of the present invention could use the surface envelope of stimulated reservoirs volumes instead of the planar fractures, for the generation of these pressure maps.

Figure 4:
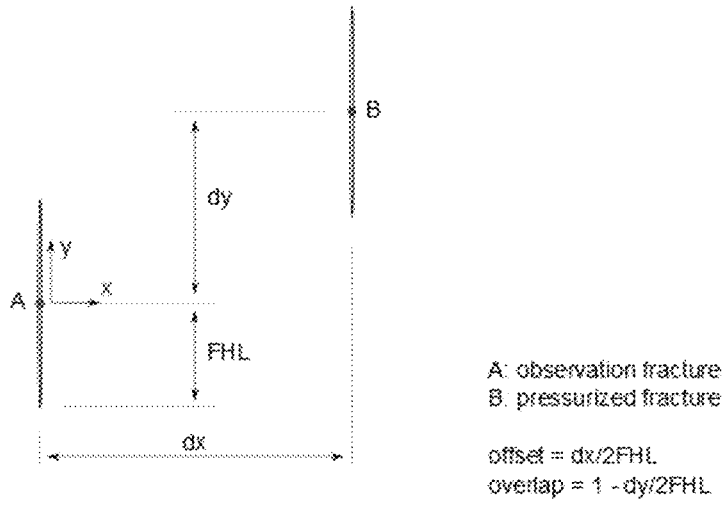
FIG. 4 is a plan view for a setup of the hydraulic fracture geometries used to generate a Pore Pressure Map according to one embodiment of the present invention.

It is noted that each fracture stage has a distance to the observation fracture, which can be described in a local coordinate system. This distance can be inferred or approximated based on the spatial location of the stages. The local coordinate system needs to be transferred into the coordinate system used in the pore pressure maps. FIG. 4 is a plan view for a setup of the hydraulic fracture geometries used to generate a Pore Pressure Map according to one embodiment of the present invention.

The discretized domain is 4000 ft×4000 ft×2000 ft (width×length×height). The x/y plane acts as a symmetry plane. In the center of the plan view, a fracture in the form of an ellipsoid is incorporated, representing the predefined geometry of a newly created hydraulic fracture at its final stage with an assumed fracture half length (FHL). At a distance (dx, dy) from its origin, a second fracture is placed representing a proppant filled observation fracture in the monitor well (in direct fluid communication with a surface pressure gauge). This second fracture is assumed to have the same geometry, for simplicity in this conceptual example. It is also assumed to be parallel to the first fracture and has its origin in the same z-coordinate. The long axes of the fractures are aligned with the y direction and the height is aligned with the z-direction. The fracture height is varied in this study to explore the influence of the fracture height on the poroelastic pressure response. As shown in FIG. 4, "A" represents the observation fracture, and "B" represents the stimulated or pressurized fracture. The offset and overlap between the observation fracture (A) and the stimulated or pressurized fracture (B) are defined as follows:

$$\text{overlap}=1-dy/2\text{FHL}; \text{ and}$$

$$\text{offset}=dx/2\text{FHL},$$

wherein "dx" represents a distance between the center of the observation fracture (A) and the center of the stimulated or pressurized fracture (B) along an x-axis, "dy" represents a distance between the center of the observation fracture (A) and the center of the stimulated or pressurized fracture (B) along an y-axis, "FHL" represents the Fracture Half Length of the observation fracture (A).

The calculations are setup such that the initial stresses are applied and the displacements are zero. Hence, the simulation starts from an equilibrium state of an undeformed system. Pressure is then continuously increased in the stimulated fracture starting from the minimum horizontal stress and reaching the maximum pressure. The loading of the fracture walls, over the time interval it takes for a HF-stimulation stage, results in a volumetric increase of the fracture, which compresses the adjacent fluid saturated porous rock. This compressional volumetric strain increases the pore pressure in the surrounding matrix due to the semi-undrained conditions in ultra-low permeability systems. The transient pressure response in the observation fracture is the result of a single simulation and is the basis for the further analysis.

Figure 5:
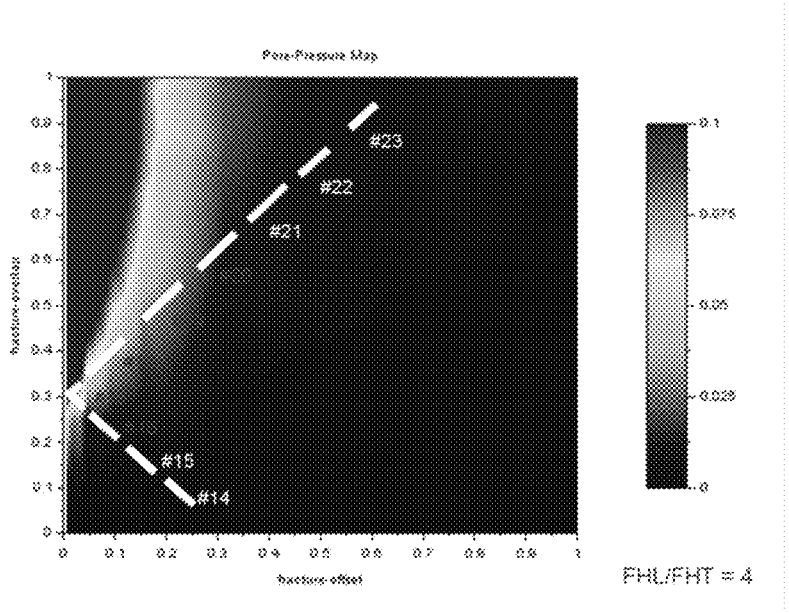
FIG. 5 is a Pore Pressure Map according to one embodiment of the present invention.

The next step consists in performing a series of such simulations for various distances (dx and dy) of pressurized and observation fractures in a systematic way. For ease of plotting, the relative positions of the induced fracture and observation fracture in x and y coordinates are normalized to an offset dx/2FHL and an overlap (1−dy/2FHL). The corresponding pressure increase in the observation well is normalized by the net-pressure. The normalized pressures at certain times for each of the simulation can be then plotted as surface plots in so called pore pressure maps as shown in FIG. 5. One map is created for a defined FHL/FHT ratio and a certain point in time during the stimulation.

Based on the introduced coordinate system above (dx, dy into offset and overlap), the top to bottom of each stage can be plotted on the pore pressure map. The series of stages is displayed as a trace across the pore pressure map. The measured pressure increases from the individual stages are normalized with the net pressure applied in the stimulated stage to identify the contour. In order to fit the monitored pore pressure increase along the trace to the map, either the FHL or the FHL/FHT ratio needs to be varied. It should be noted that variation of the FHL results mainly in a shift of the trace of the stages along the overlap direction. Pressure maps for different FHL/FHT ratios are then combined with varying assumptions on fracture half-length and offsets.

FIG. 5 is a Pore Pressure Map according to one embodiment of the present invention. The Pore Pressure Map shows history match of poroelastic pressure response observed in a series of stages of a stimulated well from an observation fracture in an adjacent observation well. The history match provides the overlap and offset for each stage as well as the FHL/FHT ratio of 4.

The determined hydraulic fracture geometries according to the above described analysis may optimize the spacings between two or more wells penetrating the subterranean formation, and the forming of a further fracture emanating from the adjacent well(s).

In one or more embodiments of the present invention, the analysis uses information related to the Young's modulus of the subterranean formation, the Poisson's ratio of the subterranean formation, the porosity of the subterranean formation, the compressibility and viscosity of the fluid in the subterranean formation, the Biot coefficient of the subterranean formation, the Young's modulus of the matter in the fracture created in the adjacent well(s) while monitoring the pressure change in the monitoring stage, the Poisson's ratio of the matter in the fracture created in the adjacent well(s) while monitoring the pressure change in the monitoring stage, the porosity of the matter in the fracture created in the adjacent well(s) while monitoring the pressure change in the monitoring stage, the compressibility and viscosity of the fluid in the matter in the fracture created in the adjacent well(s) while monitoring the pressure change in the monitoring stage, and the Biot coefficient of the matter in the fracture created in the adjacent well(s) while monitoring the pressure change in the monitoring stage.

In one or more embodiments of the present invention, a change in the geometric parameter over a period of time can be determined, information related to the distribution of a bulk material contained in the fracture in the adjacent well(s) can be determined, and planar fractures and complex fracture networks can be distinguished.

One of the key elements in the present invention is the concept of isolating an observation stage in a monitor well using a bridge plug prior to that stage and using that well as a monitor well while stages in adjacent wells before and after that stage are hydraulically fractured. One of the reasons this has not been done before is that maintaining efficiency is absolutely critical in hydraulic fracturing operations. The present invention allows for providing an intrinsic waiting period by isolating an exact location in the monitor well to better understand the location by receiving signals from a surface pressure gauge that is in direct fluid communication with the isolated location, while maintaining efficiency of operations, and not costing any additional time for operations. The method of the present invention collects more useful data by isolating communication with a single stage in the monitor well than along the whole monitor wellbore, so as to obtain a better mapping of hydraulic fracture proximity and overlap of new fractures growing near the monitor fractures than would be achieved in a case where all stages are in communication with the surface pressure gauge.

The present invention further determines the geometric fracture parameter using the recorded pressure changes in the monitoring well in an analysis which couples a solid mechanics equation and a pressure diffusion equation, which enables an accurate evaluation of fracture communication, well to well communication, hydraulic fracture proximity and overlap, and thereby obtain an optimal well spacing for future drilling operations. The present invention substantially improves upon the interpretation of the geometry of the created hydraulic fracture, i.e., the fracture height and the fracture length. The analysis is based on the stress shadow effect due to fracture dilatation of the newly created hydraulic fracture. Hence, the results are not influenced by secondary effects not directly related to the hydraulic fracture geometry, which has been identified as a source of uncertainty in the case of interpreting fracture geometry based on microseismic events. This approach requires only minor deviations from traditional practices (low execution risk), costs a fraction of other hydraulic fracture mapping techniques, and can be implemented without interfering with fracturing operations or completions efficiency. Thus, the present invention enables the mapping of general connectivity, proximity, and geometry of hydraulic fractures, the identification of direct well to well fluid communication during fracturing, the identification of a pre-existing connected fracture network, and evaluation of enhanced oil recovery processes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A computer-implemented method of evaluating a geometric parameter of a first fracture emanating from a first wellbore penetrating a subterranean formation, the method comprising the steps of:

(a) providing pressure data comprising a first pressure change, due to forming the first fracture, measured in a second wellbore comprising a second fracture;

(b) performing a simulation, using an analysis which couples a solid mechanics equation and a pressure diffusion equation to resolve the effective stress field and the fluid pressure field from which an expected pressure change in the second fracture at a certain distance to the first fracture is obtained;

(c) repeating step (b), in a series of simulations, for various distances between the two fractures;

(d) generating fracture geometry specific data sets that provide the expected pressure changes as a function of a spatial relationship between the first fracture and the second fracture; and (e) determining the geometric parameter of the first fracture using at least the measured first pressure change and the fracture geometry specific data sets.

2. The method of claim 1, wherein during the step (a), there was no mass transport between the first fracture and the second fracture.

3. The method of claim 1, wherein during the step (a), no molecule existed in the first fracture exists in the second fracture simultaneously.

4. The method of claim 1, wherein the analysis uses a computer simulation.

5. The method of claim 1, wherein the coupling between the solid mechanics equation and the pressure diffusion equation is two-way.

6. The method of claim 5, wherein both equations comprise a pressure term and a porosity term, and the equations are solved simultaneously.

7. The method of claim 1, further comprising the steps of:

providing pressure data comprising a second pressure change, due to forming a third fracture in fluid communication with the first wellbore, measured in the second wellbore in proximity to the first wellbore; and wherein the step (e) uses the measured first pressure change and the measured second pressure change.

8. The method of claim 1, wherein the step (d) comprises the step of generating fracture geometry specific surface plots from the fracture geometry specific data sets.

9. The method of claim 1, further comprising the step of designing a spacing between two or more wells penetrating the subterranean formation based on the analysis.

10. The method of claim 1, further comprising the step of using the analysis as a basis for deciding to form a fourth fracture emanating from a third well penetrating the subterranean formation.

11. The method of claim 1, wherein the analysis uses information related to at least one of the Young's modulus of the subterranean formation, the Poisson's ratio of the subterranean formation, the porosity of the subterranean formation, the compressibility and viscosity of the fluid in the subterranean formation, the Biot coefficient of the subterranean formation, the Young's modulus of the matter in the first fracture, the Poisson's ratio of the matter in the first fracture, the porosity of matter in the first fracture, the compressibility and viscosity of the fluid in the matter in the first fracture, and the Biot coefficient of the matter in the first fracture.

12. The method of claim 1, further comprising the step of determining a change in the geometric parameter over a period of time.

13. The method of claim 1, further comprising the step of determining information related to a distribution of a bulk material contained in the first fracture in the first wellbore.

14. The method of claim 1, further comprising the step of distinguishing between planar fractures vs complex fracture networks based on the analysis.

15. The method of claim 1, wherein the first pressure change was measured at a stage in the second wellbore and exactly one stage had been completed in the second wellbore.

16. The method of claim 1, wherein the second fracture had been formed before forming the first fracture.

17. The method of claim 16, wherein the first pressure change was measured whilst forming said first fracture.

* * * * *